United States Patent [19]

Johnson

[11] 4,163,174

[45] Jul. 31, 1979

[54] OBLIQUE STREAK TUBE

[75] Inventor: Charles B. Johnson, Fort Wayne, Ind.

[73] Assignee: International Telephone & Telegraph Corp., Nutley, N.J.

[21] Appl. No.: 805,955

[22] Filed: Jun. 13, 1977

[51] Int. Cl.[2] ..... H01J 39/07; H01J 39/10

[52] U.S. Cl. ..... 315/10; 315/31 R; 313/99; 313/102

[58] Field of Search ..... 313/101, 102, 94, 95, 313/99; 250/213 VT

[56] References Cited

U.S. PATENT DOCUMENTS

| | | | |
|---|---|---|---|
| 3,391,295 | 7/1968 | Clayton | 313/95 X |
| 3,609,433 | 9/1971 | Freedman | 313/95 X |
| 3,796,901 | 3/1974 | Mayer et al. | 313/102 X |
| 3,806,756 | 4/1974 | Low et al. | 315/10 |
| 3,889,144 | 6/1975 | McGee | 313/99 |
| 4,021,693 | 5/1977 | Bradley | 250/213 VT X |

*Primary Examiner*—Robert Segal

*Attorney, Agent, or Firm*—John T. O'Halloran; Alfred C. Hill

[57] ABSTRACT

At one of the vacuum tube is disposed an opaque photocathode receiving light from a window in the other end of the tube along a light axis which is spaced from and parallel to the axis of the tube. An accelerating mesh adjacent the photocathode rapidly accelerates the light produced photoelectrons in cooperation with an oblique electron lens along a path having an angle which is oblique to the light axis and tube axis toward a target or readout device. A field mesh adjacent the readout device accelerates the photoelectrons after being deflected by deflection plates to the readout device to provide an output photoelectron streak image thereon.

6 Claims, 2 Drawing Figures

OBLIQUE STREAK TUBE

BACKGROUND OF THE INVENTION

This invention relates to streak tubes and more particularly to an oblique streak tube.

The closest previously known streak tube for achieving high-quantum efficiency at short wavelengths (X-ray and ultraviolet wavelengths) is that described by P. R. Bird et al in the article entitled "Picosecond Chronography At X-ray Wavelengths", Proceedings of the Eleventh Congress on High Speed Photography, University of London, 1974. In this article an opaque photocathode is used. However, the light is focused onto the opaque photocathode in the streak tube through a window in the sidewall of the tube. The input light strikes the photocathode at a steep slant angle (the optical ray makes an angle of only a few degrees with respect to the plane of the photocathode) and this puts severe restrictions on the input optical interface (depth of focus, alignment, optical speed, etc.) between the streak tube and the optical system.

SUMMARY OF THE INVENTION

An object of the present invention is to provide an oblique streak tube employing a more conventional optical interface while all the inherent features of the oblique electron lens and magnetically focused streak tubes are retained.

Another object of the present invention is that all optical elements, such as lenses, prisms and mirrors, are external to the oblique streak tube.

A further object of the present invention is to provide an oblique streak tube whose optical image plane at the photocathode is perpendicular to the optical axis.

A feature of the present invention is the provision of an oblique streak vacuum tube having a longitudinal axis comprising: first means disposed in and at one end of the tube responsive to light passing through the other end of the tube along a light axis spaced from and parallel to the longitudinal axis to produce photoelectrons; second means disposed in the tube to rapidly accelerate the photoelectrons away from the first means in a path toward the other end of the tube at an angle oblique to the light axis and the longitudinal axis and to deflect the photoelectrons; and third means disposed in the path and at the other end of the tube to receive the photoelectrons from the second means to provide an output photoelectron streak image.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

The oblique streak tube of the present invention can be used anywhere other streak tubes are used, but it can also be employed to detect short-duration, high-frequency photon events in the near infra-red to soft X-ray spectral regions. It can detect optical events which occur in time intervals and having repetition rates of approximately $10^{-12}$ seconds and $10^{12}$ Hertz, respectively, or less. The problem of being able to utilize an opaque photocathode with high-quantum efficiency and with a high-limiting-resolution electron lens within this spectral range is solved by employing the oblique electron lens described in the following two articles: C. B. Johnson et al, "The Oblique Electron Lens", IEEE Transactions of Electron Tube Development ED-20, Page 660, 1973; and C. B. Johnson et al, "Correction To The Oblique Electron Lens", IEEE Transactions of Electron Tube Development ED-21, Page 131, 1974; and U.S. Pat. No. 3,806,756. The disclosure of the above articles and U.S. patent are incorporated herein by reference.

The problem of rapidly deflecting the electron image across a suitable readout/gain target is solved by making use of the general design principles described in the co-pending application of C. B. Johnson and J. M. Abraham, Ser. No. 708,813, filed July 26, 1976, entitled "Magnetically Focused Streak Tube", whose disclosure is incorporated herein by reference.

Figure 1:
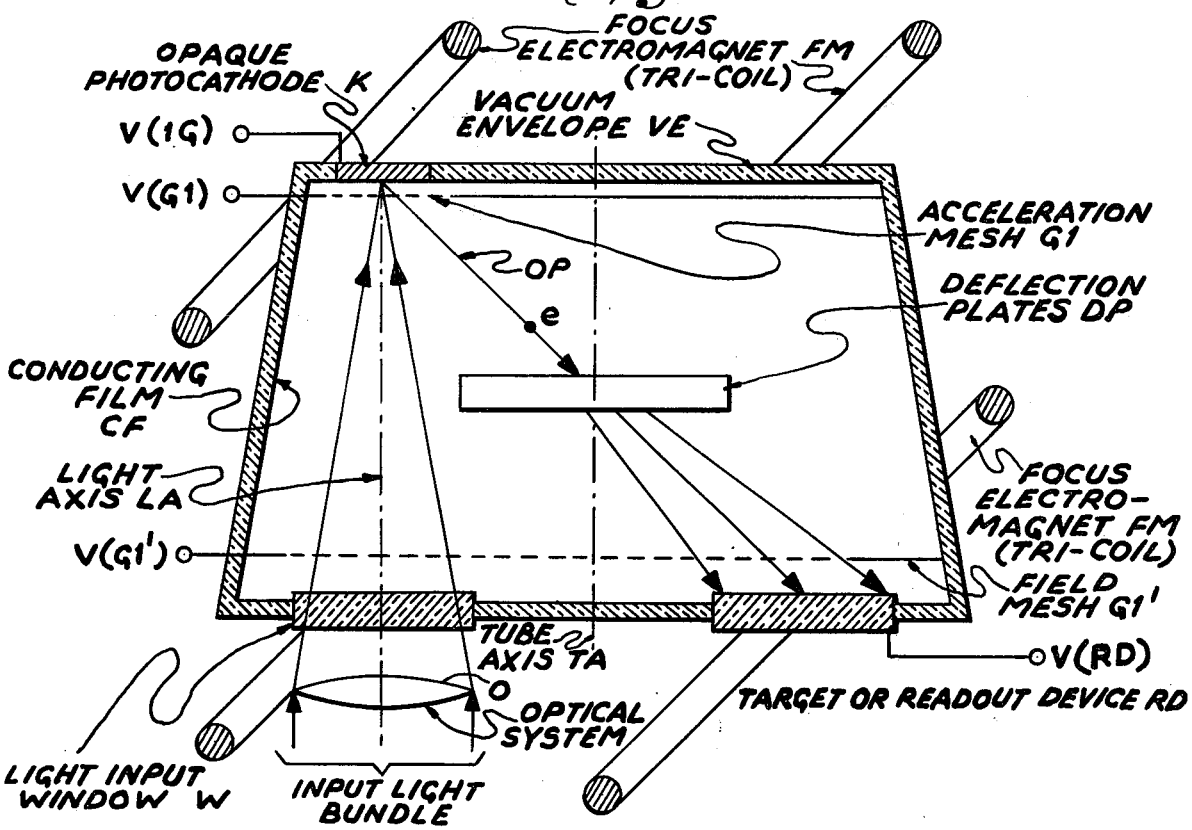
FIG. 1 is a schematic longitudinal cross-sectional view of the oblique streak tube, looking down on the tube, in accordance with the principles of the present invention.
Figure 2:
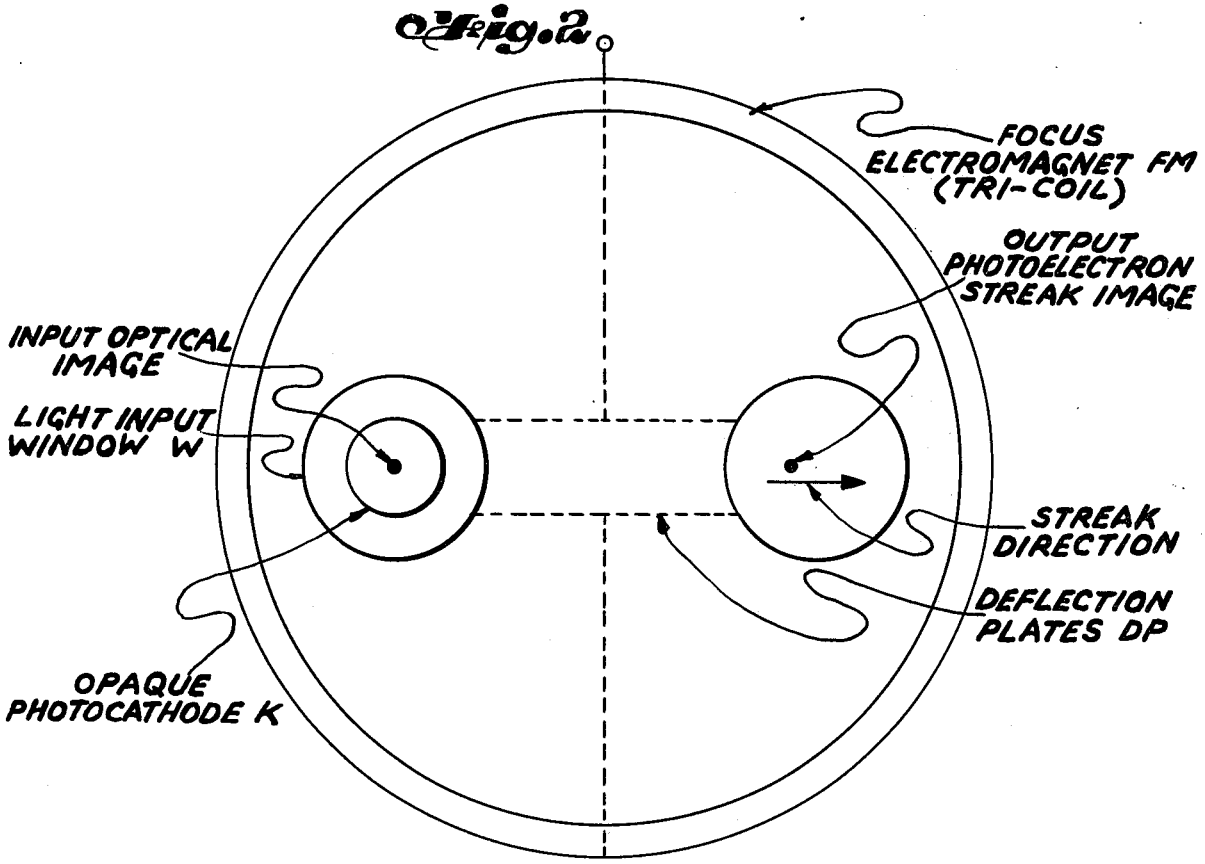
FIG. 2 is a front view of the oblique streak tube of FIG. 1.

Referring to FIGS. 1 and 2, there is disclosed therein the oblique streak tube of the present invention. The input optical radiation or light is focused by the optical system O through a light input window W disposed in the vacuum envelope VE. It should be noted that the optical system O is external of the oblique streak tube. The light passing through window W is received by an opaque photocathode K also included in the vacuum envelope VE along a light axis LA which is spaced from and parallel to the tube axis TA. Envelope VE may be made from glass with the inner surface thereof plated with a conducting film, e.g. Nichrome, CF.

The photoelectrons produced by photocathode K are rapidly accelerated along a path OP which is oblique to the axis LA and axis TA by the cooperation of the acceleration mesh G1 and the oblique electron lens which includes as a portion thereof the tri-coil focus electromagnet FM. The photocathode K has a voltage V(K) of 0 volts applied thereto, while mesh G1 which is spaced very close to the photocathode K (within one or two millimeters) has a voltage V(G1) of between 1 to 2 kV (kilovolts) applied thereto. Field mesh G1′ which is disposed adjacent to the readout device RD has a potential of V(G1′) in the order of 1 to 2 KV applied thereto. The potentials V(G1) and V(G1′) are equal so as to maintain a constant potential between the two meshes G1 and G1′ to enable operation of the deflection plates to deflect a moving photoelectron beam having a constant velocity across the readout device RD to produce an output photoelectron streak image thereon. The output photoelectron streak image is a linear charge pattern along the direction of the scan axis, i.e. the time axis, which is proportional to the incoming light intensity to the tube. The deflection of the photoelectron is performed by deflection plates DP disposed between mesh G1 and mesh G1′.

The light input window W may be composed of a material depending upon the wavelength region of the light focused thereon by the optical system O. In the visible light region, window W could be plain glass. In the ultraviolet region, window W could be quartz or magnesium fluoride. For shorter wavelengths, such as X-rays, window W would be made of berylium or would be an open window in a vacuum system or an outer space (not shown) environment.

The potential V(RD) on readout device RD is in the order of 15 to 20 kV to provide a high acceleration of the deflected photoelectrons from mesh G1′ to readout device RD.

The readout device RD may be a phosphor screen, a microchannel plate, an electron bombarded self-scanned array, an intensified charge-coupled device, an intensified charge-injection device, an intensified silicon diode array, etc., or a combination of these or similar electron gain/storage targets of the type used in electron image intensifiers and camera tubes. As previously mentioned, deflection plates DP provide an electric field which is used to deflect the focused output electron image across the electron target or readout device RD in a manner very similar to that described in the above-cited co-pending application.

If deflection plates DP were not provided, as is the case in the above-cited U.S. Pat. No. 3,806,756, the electron-optical image of the optical input provided by opaque photocathode K would be focused onto readout device RD by the action of the oblique electron lens which provides a magnetic field produced by external magnet FM and the electric fields produced by opaque photocathode K, accelerating mesh G1, field mesh G1′ and readout device RD. When deflection plates DP are provided and potentials are applied thereto, the focused electron-optical image is deflected across readout device RD while remaining in focus at readout device RD. Thus, deflection plates DP operate to deflect the electron-optical image at the output of photocathode K across readout device RD in a short enough period of time so that smaller time response increments can be resolved by the oblique streak tube of the present invention.

One operational difference between the oblique streak tube and the more conventional magnetic streak tube is that in the oblique streak tube the electric and magnetic focus fields make an angle with respect to each other which is not equal to 0° or 180°, while in the conventional magnetic streak tube, the electric and magnetic focus fields are co-linear. Thus, the angle between the electric and magnetic focus fields of the oblique streak tube is such that the output electron streak is displaced in a direction normal to the plane of the electric and magnetic fields. The amount of displacement depends upon the exact tube design (spacing between all tube elements, focus field strengths, and operating potentials of the various meshes, photocathode and readout devices), but the magnitude of the exact displacement will not be more than a few millimeters in practical tubes. In addition, the output streak will be linear, accept for "S-distortion" which will occur at the extremes of the streak displacement, the exact magnitude of this distortion also depending upon the specific tube design.

With respect to the oblique electron lens, the electrons tend to spiral along the magnetic field lines. An adjustment of the electric acceleration fields between photocathode K and mesh G1 and readout device RD and mesh G1′ including the mesh spacing with their associated photocathode K and readout device RD, respectively, and the potential applied to these elements enables adjustment of the magnetic field to ensure that the photoelectrons are focused on the target or readout device RD.

While I have described above the principles of my invention in connection with specific apparatus it is to be clearly understood that this description is made only by way of example and not as a limitation to the scope of my invention as set forth in the objects thereof and in the accompanying claims.

I claim:

1. An oblique streak tube having a vacuum envelope with a longitudinal axis comprising:

means disposed in and at one end of said envelope responsive to light passing through the other end of said envelope along a light axis spaced from and parallel to said longitudinal axis to produce photoelectrons;

an accelerating mesh having a given potential applied thereto disposed within said envelope adjacent said first means to rapidly accelerate said photoelectrons away from said means in a path toward said other end of said envelope at an angle oblique to said light axis and said longitudinal axis;

a field mesh having said given potential applied thereto disposed within said envelope and adjacent said other end of said envelope, said given potential applied to said accelerating mesh and said field mesh providing a region of constant potential between said accelerating mesh and said field mesh to enable deflection of said photoelectrons adjacent said path in said region, said photoelectrons having a constant velocity in said region;

readout means having a selected potential applied thereto greater than said given potential disposed in said other end of said envelope in said path adjacent said field mesh, said readout means being capable of providing an output photoelectron streak image for said tube, said given potential applied to said field mesh and said selected potential cooperating to accelerate said photoelectrons adjacent said path to said readout means;

magnetic means disposed externally of said envelope coextensive with said means and said readout means to provide a focusing magnetic field parallel to said path to focus said photoelectrons on said readout means; and deflection plates disposed adjacent said path between said accelerating mesh and said field mesh in said region to deflect said focused photoelectrons across said readout means to produce said output photoelectron streak image on said readout means;

and means external to said streak tube for supplying said given potential to said accelerating mesh and to said field mesh.

2. A tube according to claim 1, wherein said means includes a photocathode.

3. A tube according to claim 2, wherein said photocathode is an opaque photocathode.

4. A tube according to claim 1, further including a light input means disposed in said other end of said envelope coaxial of said light axis to pass said light.

5. A tube according to claim 4, wherein said means includes a photocathode.

6. A tube according to claim 5, wherein said photocathode is an opaque photocathode.

* * * * *